US007150636B2

(12) United States Patent
Zhu et al.

(10) Patent No.: US 7,150,636 B2
(45) Date of Patent: Dec. 19, 2006

(54) ELECTRICAL CARD CONNECTOR WITH PROTECTIVE DEVICE

(75) Inventors: ZiQiang Zhu, Kunshan (CN); Jinkui Hu, Kunshan (CN); Guohua Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/311,100

(22) Filed: Dec. 19, 2005

(65) Prior Publication Data

US 2006/0134947 A1 Jun. 22, 2006

(30) Foreign Application Priority Data

Dec. 18, 2004 (CN) ..... 2004 2 0054955

(51) Int. Cl.
*H01R 13/44* (2006.01)

(52) U.S. Cl. ..... 439/141; 439/630

(58) Field of Classification Search ..... 439/141, 439/140, 630

See application file for complete search history.

(56) References Cited

U.S. PATENT DOCUMENTS

| | | | | |
|---|---|---|---|---|
| 5,779,491 | A * | 7/1998 | Nagano et al. | 439/141 |
| 6,102,715 | A * | 8/2000 | Centofante | 439/140 |
| 6,139,338 | A | 10/2000 | Hirai et al. | |
| 6,203,378 | B1 * | 3/2001 | Shobara et al. | 439/638 |
| 6,733,311 | B1 * | 5/2004 | Kameda | 439/140 |
| 6,761,568 | B1 * | 7/2004 | Bakker et al. | 439/140 |
| 2006/0025019 | A1 * | 2/2006 | Zhu et al. | 439/630 |

* cited by examiner

*Primary Examiner*—Hae Moon Hyeon
(74) *Attorney, Agent, or Firm*—Wei Te Chung

(57) ABSTRACT

An electrical card connector (100) for compatibly electrically connecting with a number of electronic cards (5), includes an insulator (1) defining a number of recesses (111, 112, 113, 114) for insertion of the electronic cards, a number of contacts (2) assembled to the insulator (1) and a protective device (3) provided with a pair of resilient arms (312). Each resilient arm is formed with a hook (3121) engageable with the insulator. The protective device slides to expose the contacts when a suitable card is inserted.

19 Claims, 8 Drawing Sheets

ELECTRICAL CARD CONNECTOR WITH PROTECTIVE DEVICE

BACKGROUND OF THE INVENTION

1. Field of the Invention

The present invention relates to an electrical card connector adapted for permitting various of electronic cards to be compatibly nestled therewith.

2. Description of Related Art

Electrical card connectors are widely used in computer industry for electrically connecting with inserted electronic cards which function as removable mass storage devices. With an apparently increasing of various types of electronic cards, an electrical card connector capable of compatibly insertion of various of electronic cards is required.

A conventional Compact Flash card (CF card) adapter described in U.S. Pat. No. 6,139,338 comprises an U-shaped plastic frame formed with a pair of legs, an adapter substrate integrally connected to a front portion of the plastic frame, a pin header having a plurality of pins capable of mating with a CF card. The pin header comprises a header housing, a pair of round rods longitudinally extending rearwardly on a pair of opposite sides of header housing, a pair of coiled spring loosely encircling around the round rods and a plastic retention portion securely covering rear portions of the pins. The retention portion is provided with a body portion and a pair of extensions projecting laterally from an outer surface of the body portion. The frame has a pair of engaging portions formed on the opposite legs thereof for engaging with the extensions. The retention portion is driven rearward in a normal statue under a resilient force provided by the coiled springs. When a CF card is inserted into an opening defined between the opposite engaging portions of the U-shaped frame, the retention portion would yieldingly withdraw to expose the pins for permitting the pins to be mated with a plurality of terminals of the CF card.

The body portion and the opening must have substantially the same width for permitting the extensions to be engaged with the engaging portions. Therefore, when the retention portion is assembled to the frame through the opening, the extensions projecting laterally from the outer surface of the body portion would be held up by the engaging portions thus to make the assembling process quite difficult. Additionally, the CF card adapter is just adapted for electrically connecting with the CF card and can not compatibly connect with any other types of electronic cards.

Hence, an improved electrical card connector is required to overcome the above-mentioned disadvantages of the related art.

SUMMARY OF THE INVENTION

A primary object of the present invention is to provide an electrical card connector capable of compatibly connecting with various of electronic cards.

Another object of the present invention is to provide an electrical card connector having a protective device capable of being easily assembled thereto.

To achieve the aforementioned objects, an electrical card connector for compatibly electrically connecting with a plurality of electronic cards, comprising: an insulator defining a number of recesses for insertion of the electronic cards, a number of contacts assembled to the insulator and a protective device provided with a pair of resilient arms. Each resilient arm is formed with a hook engageable with the insulator. The protective device slides to expose the contacts when a suitable card is inserted.

Other objects, advantages and novel features of the invention will become more apparent from the following detailed description of a preferred embodiment when taken in conjunction with the accompanying drawings.

DETAILED DESCRIPTION OF THE INVENTION

Figure 1:
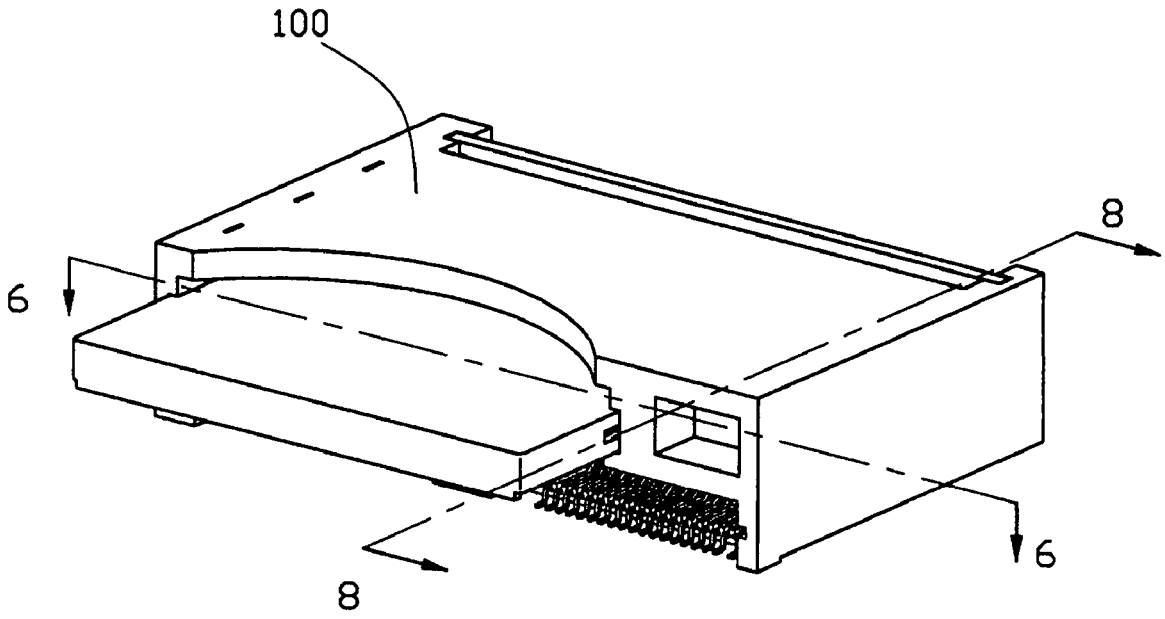
FIG. 1 is an assembled perspective view of an electrical card connector in accordance with the present invention with a CF card is inserted therein.
Figure 2:
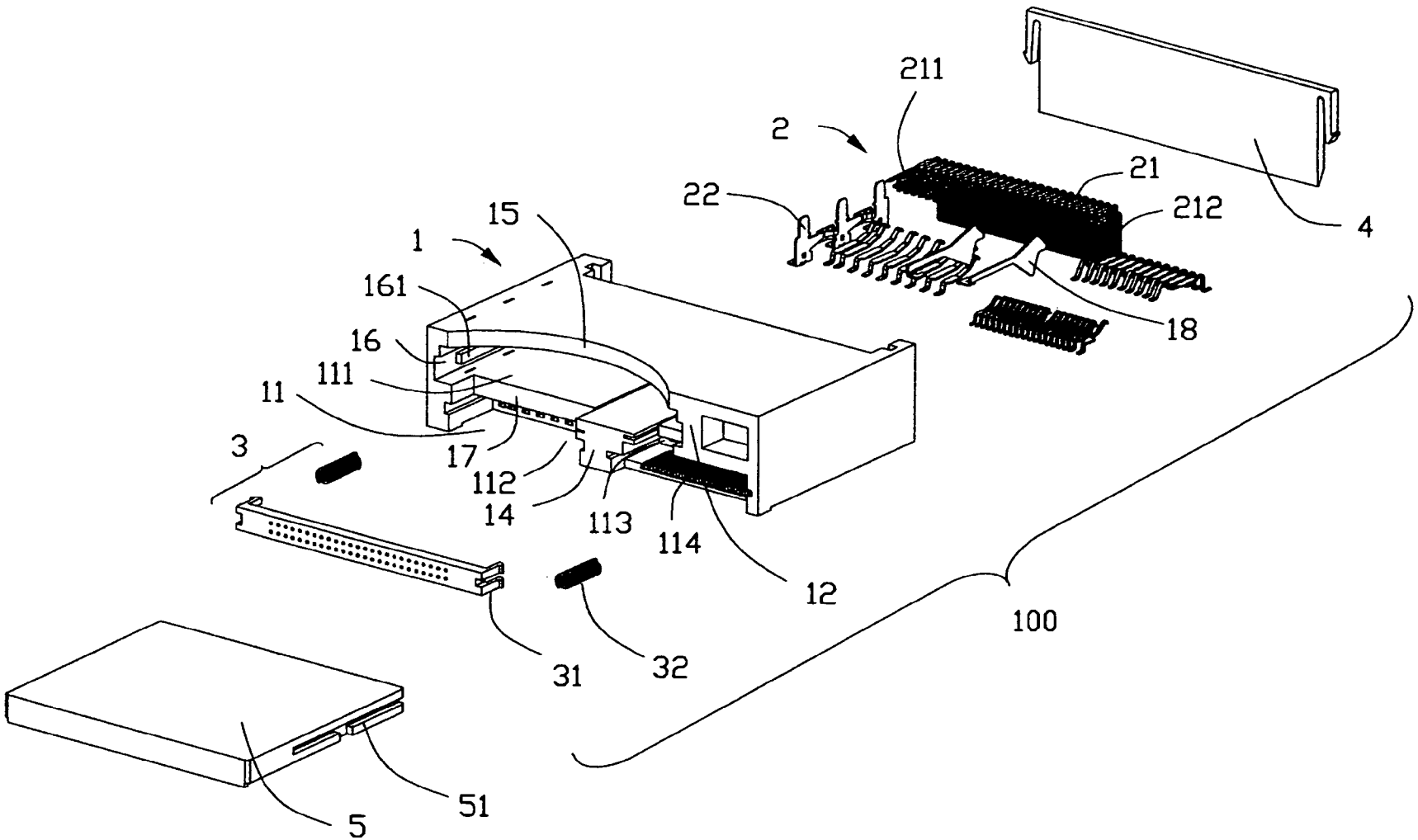
FIG. 2 is an exploded view of the electrical card connector as shown in FIG. 1.

Reference will now be made to the drawing figures to describe the present invention in detail. Referring to FIG 2, an electrical card connector 100 in accordance with the preferred embodiment of the present invention is adapted for compatibly electrically connecting with a CF card 5, the Secure Digital/Multimedia card (SD/MMC card, (not shown), the Memory Stick card (MS card, (not shown) and the xD-picture Card (XD card, (not shown).

Figure 3:
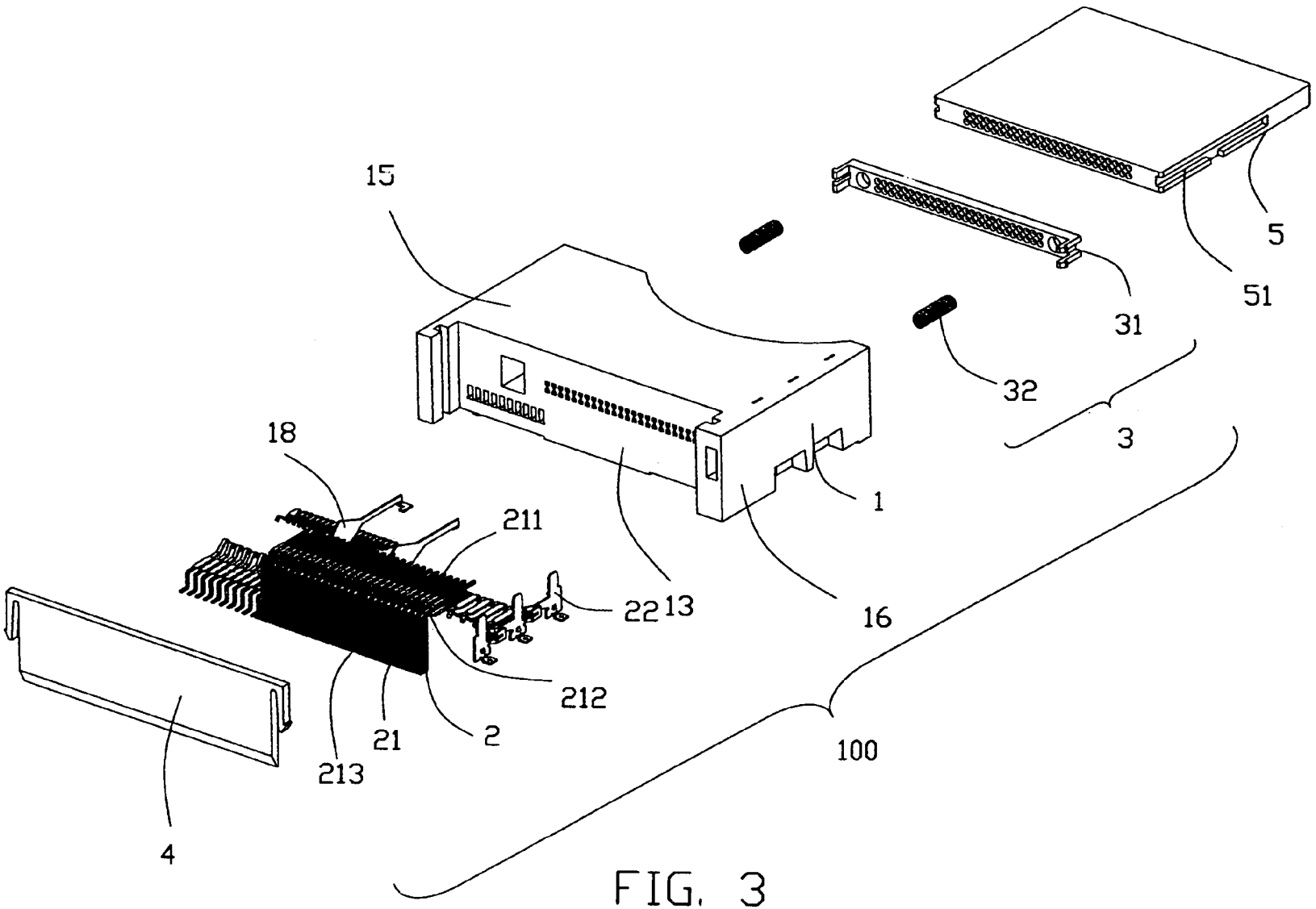
FIG. 3 is an exploded view of the electrical card connector of FIG. 2 taken from another aspect.

Referring to FIG. 2 in conjunction with FIG. 3, the electrical card connector 100 comprises an insulator 1, a plurality of contacts 2 embedded in the insulator 1, a protective device 3 assembled to the insulator 1 and a cover 4 attached to a rear portion of the insulator 1.

Figure 5:
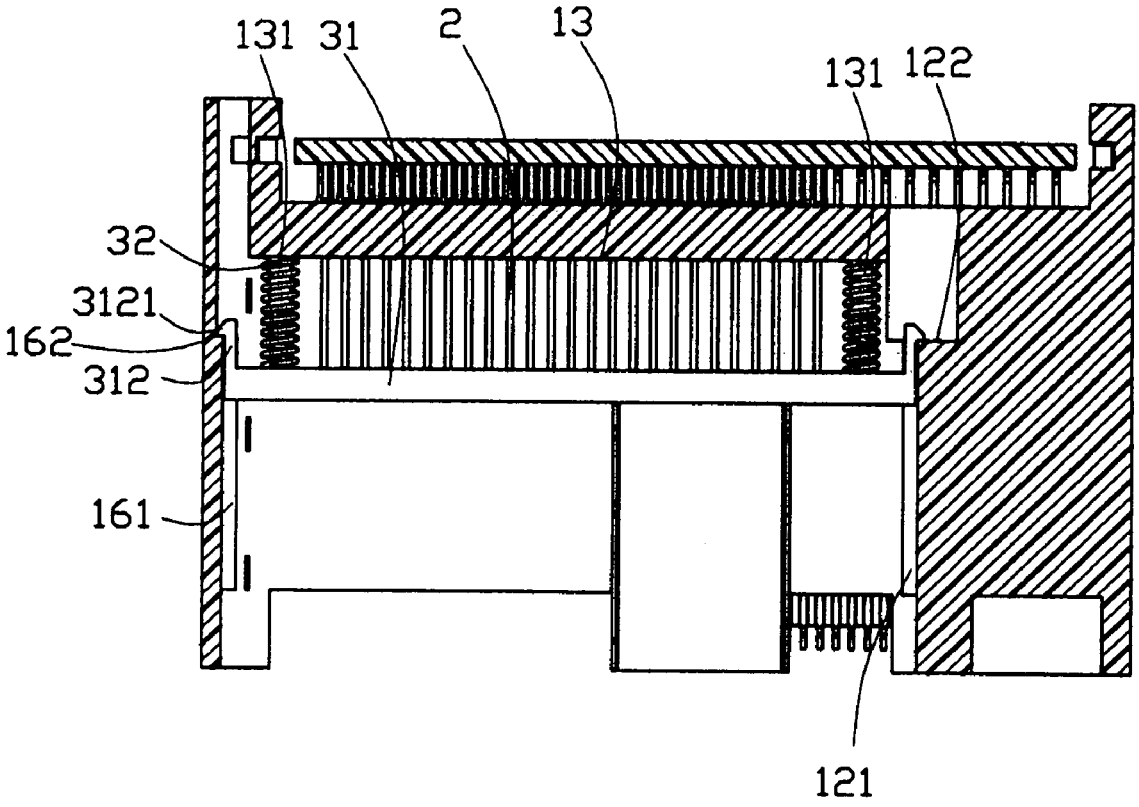
FIG. 5 is a cross-sectional view of the electrical card connector as shown in FIG. 1 taken along line 6—6 before the CF card is inserted therein.

Referring to FIG. 2, 3 in conjunction with FIG. 5, the insulator 1 is a substantially rectangular case, comprising a rear wall 13, a forwardly extending periphery wall 16, an inner wall 12 and a top wall 15 to thereby define a cavity 11 therebetween. The insulator 1 has a longwise-extended separator 14 formed in the cavity 11 and a rectangular tongue portion 17 formed between the periphery wall 16 and the separator 14. The tongue portion 17 extending parallel to the top wall 15 connects a middle portion of the periphery wall 16 and a top portion of the separator 14 together to thereby make the cavity 11 divided into a plurality of recesses. The tongue portion 17 has a CF card recess 111 corresponding to the CF card 5 defined thereabove and an SD/MMC card recess 112 corresponding to the SD/MMC card defined therebelow. An MS card recess 113 corresponding to the MS card is defined between the separator 14 and the inner wall 12. The MS card recess 113 has an XD card recess 114 corresponding to the XD card defined therebelow and communicating therewith.

The inner wall 12 and the periphery wall 16 respectively has a flange 121, 161 projecting inwardly therefrom and extending along an insertion direction of the CF card 5 for engaging with a pair of grooves 51 defined at lateral edges of the CF card 5. Additionally, the inner wall 12 and the periphery wall 16 are respectively provided with a step-like engaging portion 122, 162 at a rear end thereof. The rear wall 13 has a pair of posts 131 projecting forwardly from an inner surface thereof. The insulator 1 additionally comprises a pair of resilient member 18.

The contacts 2 comprises a plurality of electrically contacts 21 and a plurality of detect contacts 22. Each electrical contact has a intermediate portion 212, a forwardly extending contact end 211 and a soldering foot 213.

Figure 4:
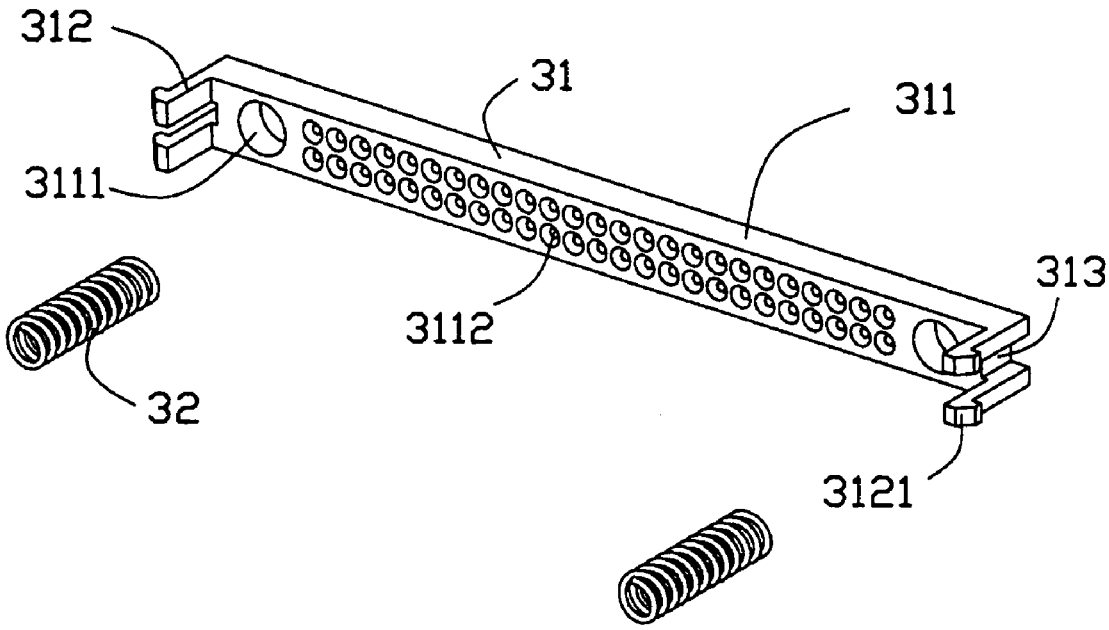
FIG. 4 is a perspective view of the protective device as shown in FIG. 2.

Referring to FIG 4, the protective device 3 comprises a moveable portion 31 and a pair of coiled springs 32 mounted on the moveable portion 31. The moveable portion 31 comprises a rectangular body portion 311 and two pairs of resilient arms 312 extending perpendicularly from opposite sides of the body portion 311. The body portion 311 has a pair of dimples 3111 defined at an inner surface thereof and a plurality of through holes 3112 defined between the pair of dimples 3111 and arranged in two arrays. Each pair of resilient arms 312 have a slot 313 defined therebetween. Each resilient arm 312 has a hook 3121 formed at a free end thereof. Each hook 3121 has an obliquely extending guiding face formed thereon for easing insertion of the resilient arms 312 during assembly of the protective device 3 into the insulator 1.

Figure 7:
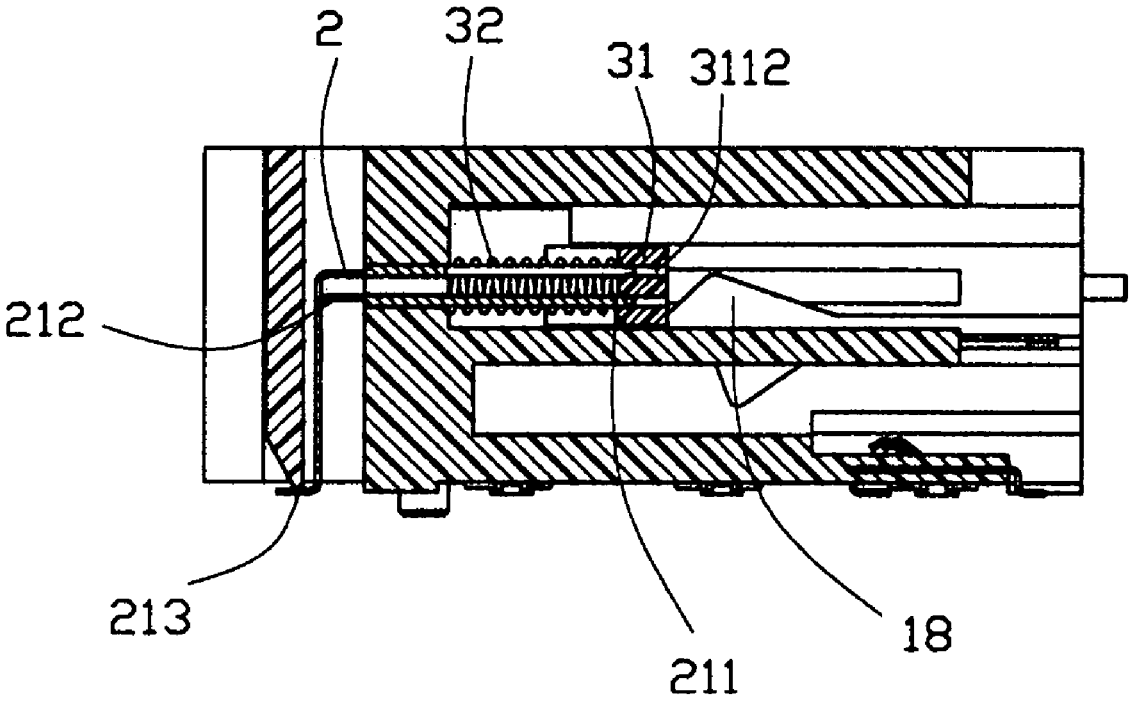
FIG. 7 is a cross-sectional view of the electrical card connector as shown in FIG. 1 taken along line 8—8 before the CF card is inserted therein.

Referring to FIGS. 1–5 in conjunction with FIG. 7, in assembly, the contacts 2 are firstly assembled to the insulator 1 with contact ends 211 thereof exposed toward the insertion direction of the cards and the soldering feet 213 extending outwardly form a bottom of the insulator 1 for soldering onto a PCB (not shown). One resilient member 18 is mounted in the insulator 1 between the CF card recess 111 and the SD/MMC card recess 112, the other resilient member 18 is disposed between the MS card recess 113 and the XD card recess 114. The pair of circle springs 32 are partly retained in the dimples 3111. The moveable portion 31 together with the circle springs 32 are inserted into the cavity 11 with the resilient arms 312 thereof resiliently bended inwardly and the flanges 121, 161 sliding in the slots 313 thereof. The protective device 3 is fixed to the insulator 1, with the circle springs 32 thereof loosely encircling around the posts 131, the body portion 311 thereof resisted against by the circle springs 32, the through holes 3112 thereof retaining the contact ends 211 of the electrical contacts 21 and the hooks 3121 thereof engaging with the engaging portions 122, 162. The cover 4 is attached to a rear portion of the insulator 1 finally for covering the contacts 2.

Figure 6:
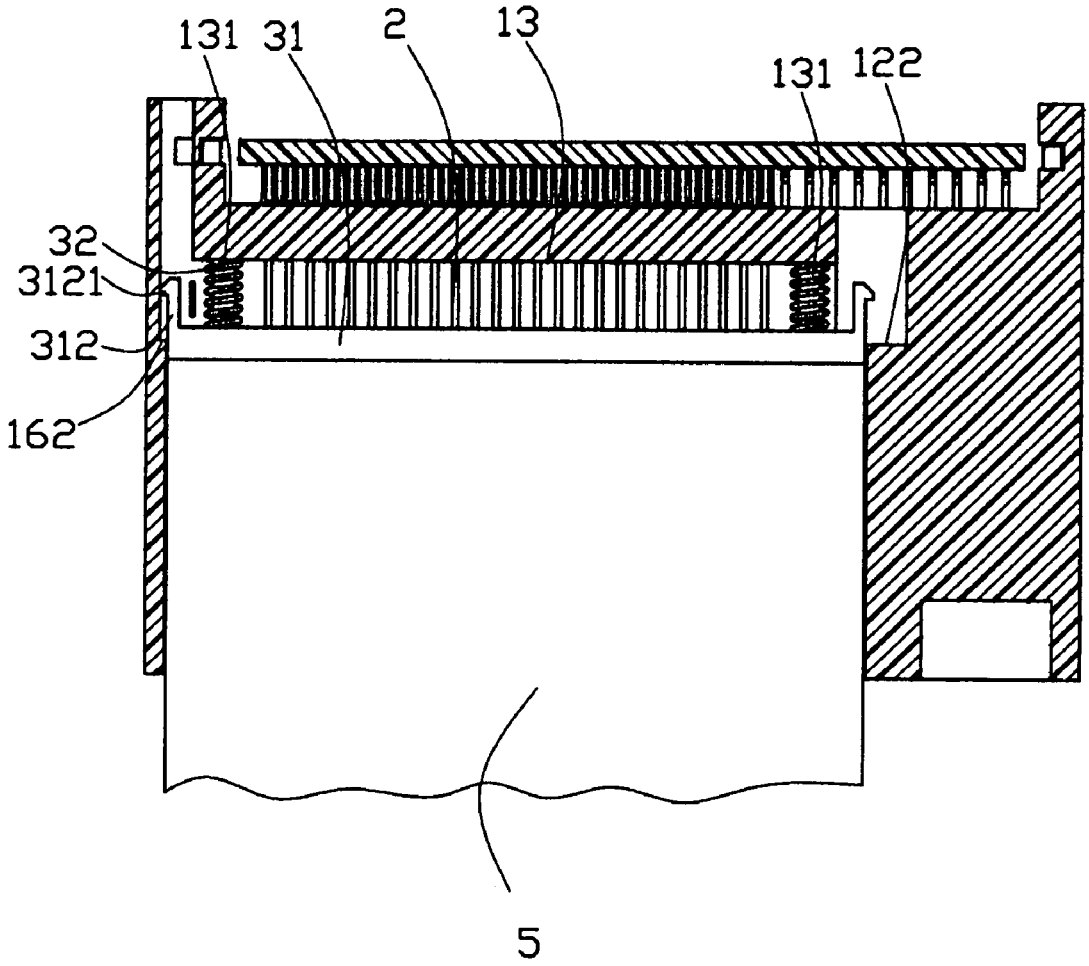
FIG. 6 is a cross-sectional view of the electrical card connector as shown in FIG. 1 taken along line 6—6 when the CF card is inserted therein.
Figure 8:
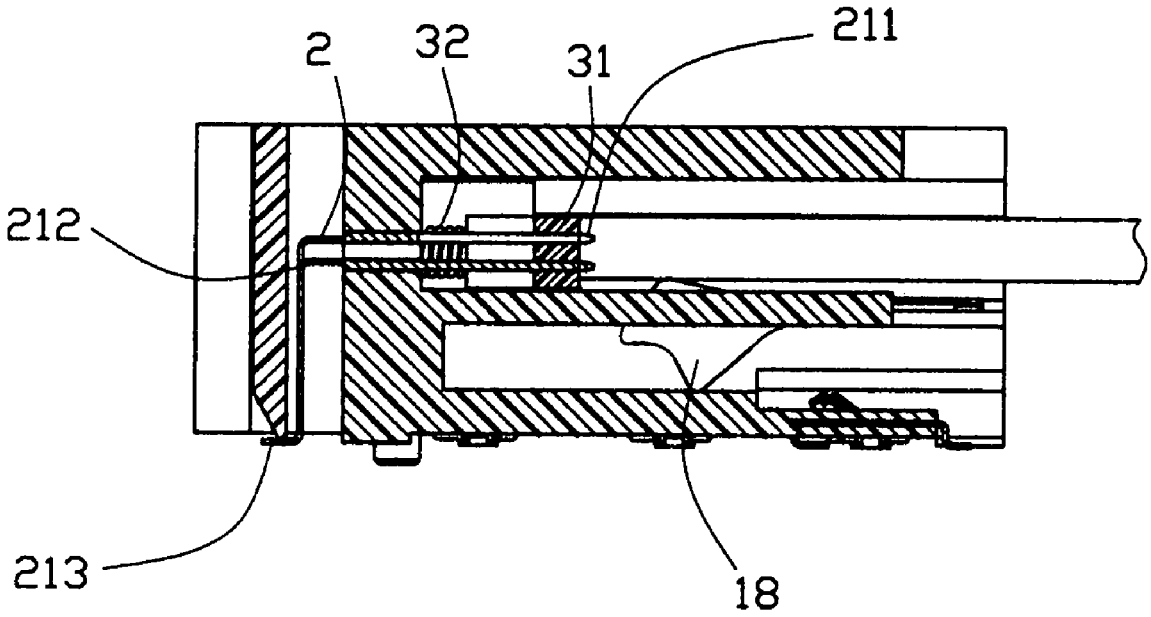
FIG. 8 is a cross-sectional view of the electrical card connector as shown in FIG. 1 taken along line 8—8 when the CF card is inserted therein.

Referring to FIG. 6 in conjunction with FIG. 8, in use, inserting a CF card 5 into the CF card recess 111 with the flanges 121, 161 sliding along the grooves 51. Meanwhile, the moveable portion 31 would yieldingly withdraw to expose the contact ends 211 of the electrical contacts 21 outside the body portion 311 to thereby permitting insertion of the electrical contacts 21 into the CF card 5. The protective device 3 locks on the insulator 1 and the electrical contacts 21 are electrically connected with the CF card 5 when the CF card 5 is fully inserted in the insulator 1. At the same time, the CF card 5 is inserted above a top portion of the resilient member 18 to thereby downwardly depress the resilient member 18. The resilient member 18 is resiliently depressed toward the SD/MMC card recess 112 to block off insertion of the SD/MMC card. Thus the SD/MMC card can't be inserted into the SD/MMC card recess 112 unless the CF card 5 is drawn out from the CF card recess 111.

To compare with the conventional invention, one merit of this invention is defining a plurality of recesses 111, 112, 113, 114 for insertion of various of electronic cards. Additionally, the moveable portion 31 is provided with two pairs of resilient arms 312 capable of being resiliently bended inwardly for avoiding making the hooks 3121 thereof being held up by the walls 12, 16, thus to ease insertion of itself into the cavity 11 during assembly.

However, the disclosure is illustrative only, changes may be made in detail, especially in matter of shape, size, and arrangement of parts within the principles of the invention.

What is claimed is:

1. An electrical card connector for compatibly electrically connecting with a plurality of types of electronic cards, comprising:

an insulator comprising a plurality of walls to define therein a cavity, said cavity having a lengthwise-extended separator and a tongue portion formed therein to divide the cavity into a plurality of recesses for insertion of the electronic card;

a plurality of contacts assembled to the insulator; and a protective device comprising a moveable portion and at least a spring mounted on said moveable portion, said moveable portion defining thereon a plurality of through holes for retaining said contacts and having at least a resilient arm, each resilient arm formed with a hook engageable with said insulator;

wherein said moveable portion is slidable to expose said plurality of contacts when a suitable card is inserted.

2. The electrical card connector as claimed in claim 1, wherein said resilient arm is capable of being resiliently bended inwardly and has the hook formed at a free end thereof.

3. The electrical card connector as claimed in claim 2, wherein said moveable portion comprises a body portion resisted against by the spring and the resilient arm extends perpendicularly from a side of the body portion.

4. The electrical card connector as claimed in claim 3, wherein said body portion has a pair of dimples defined at an inner surface of the opposite sides thereof for partly retaining the springs.

5. The electrical card connector as claimed in claim 1, wherein said insulator comprises a rear wall, a forwardly extending periphery wall, an inner wall and a top wall which together define the cavity.

6. The electrical card connector as claimed in claim 1, wherein said tongue portion extends parallel to the top wall and connects a middle portion of the periphery wall and a top portion of the separator.

7. The electrical card connector as claimed in claim 1, wherein said insulator comprises at least a resilient member disposed therein between a pair of recesses.

8. The electrical card connector as claimed in claim 7, wherein said resilient member is capable of being depressed downwardly from a recess toward another recess.

9. The electrical card connector as claimed in claim 6, wherein said periphery wall and the inner wall respectively has a flange projecting inwardly therefrom and extending along an insertion direction of the electronic card for guiding the insertion of the moveable portion during assembly and guiding the insertion of the corresponding electronic card in use.

10. The electrical card connector as claimed in claim 5, wherein said insulator has an engaging portion formed therein, said hook is engageable with said engaging portion.

11. The electrical card connector as claimed in claim 5, wherein said rear wall has at least a post projecting forwardly from an inner surface thereof for allowing the spring to encircle therearound.

12. A card connector assembly, comprising;

a card; and an electrical card connector electrically connecting said card, said connector comprising:

an insulator defining a recess for insertion of the card;

a plurality of contacts disposes in the insulator each comprising a contact end and an intermediate portion exposed in the recess; and a protective device detachably assembled on said insulator and enclosing said contact ends of said contacts until the card is correctly inserted into said recess and pushes said protective device moving along the insertion direction of said card to expose said contacts ends, said protective device locking on said insulator when said card is fully inserted in said insulator; wherein said protective device has a resilient arm, said resilient arm has a hook forming an obliquely extending guiding face for guiding insertion of the resilient arm during assembly.

13. The card connector assembly as claimed in claim 12, wherein said resilient arm is capable of being resiliently bended inwardly.

14. The card connector assembly as claimed in claim 13, wherein said protective device comprises a moveable portion and a pair of springs mounted on the moveable portion and wherein said moveable portion comprises a body portion resisted against by the spring and the resilient arm extends perpendicularly from a side of the body portion.

15. The card connector assembly as claimed in claim 14, wherein said body portion has a plurality of through holes defined in two arrays.

16. The card connector assembly as claimed in claim 14, wherein said body portion has a pair of dimples defined at an inner surface of the opposite sides thereof for partly retaining the springs.

17. The card connector assembly as claimed in claim 12, further more comprises a cover attached to a rear portion of the insulator.

18. A card connector assembly, comprising:

an insulator having at least one recess for insertion of one electronic card;

a plurality of contacts assembled to the insulator; and a protective device moveable between front and rear positions relative to the insulator along a front-to-back direction, and comprising a moveable portion defining therein a plurality of through holes for retaining said contacts and having at least a resilient arm, each resilient arm formed with a hook engageable with said insulator;

wherein said moveable portion is slidable to expose said plurality of contacts when a suitable card is inserted, and said resilient arm is configured to be adapted to be inwardly deflected to allow easy initial forward moving during assembling and successive resumption to an un-deflected manner under a condition that the hook is latchably engaged with the insulator in said front-to-back direction to keep the protective device in position when said protective device is urged by a spring to move forward.

19. The card connector assembly as claimed in claim 18, wherein said moveable portion is urged by a biasing device to move away from the contacts.

* * * * *